US005406658A

United States Patent [19]

Olkkonen et al.

[11] Patent Number: 5,406,658

[45] Date of Patent: Apr. 18, 1995

[54] LIFTING AND TRANSFER SYSTEM FOR A PATIENT

[75] Inventors: Kari Olkkonen, Kauttua; Hannu Paasonen, Nokia; Kalle Välimaa, Vanha-Ulvila, all of Finland

[73] Assignee: Ahlstrom Consumer Products Ltd., Kauttua, Finland

[21] Appl. No.: 58,500

[22] Filed: May 5, 1993

[30] Foreign Application Priority Data

May 5, 1992 [FI] Finland ..... 922011

[51] Int. Cl.[6] ..... A61G 7/10

[52] U.S. Cl. ..... 5/83.1; 5/84.1; 5/87.1

[58] Field of Search ..... 5/81.1, 83.1, 84.1, 5/87.1, 88.1, 89.1

[56] References Cited

U.S. PATENT DOCUMENTS

| | | | |
|---|---|---|---|
| 953,962 | 4/1910 | Lane | 5/87.1 |
| 2,565,536 | 8/1951 | Valentine . | |
| 2,809,381 | 10/1957 | Colaner, Sr. | 5/87.1 |
| 4,149,253 | 3/1980 | Ullven | 5/84.1 |
| 4,627,119 | 12/1986 | Hachey et al. | 5/83.1 |
| 4,739,526 | 4/1988 | Hollick | 5/83.1 |
| 5,005,233 | 4/1991 | Toivo et al. . | |
| 5,072,840 | 12/1991 | Asakawa et al. | 5/83.1 X |
| 5,177,822 | 1/1993 | Kassai | 5/81.1 X |
| 5,187,821 | 2/1993 | Nieminen et al. . | |

FOREIGN PATENT DOCUMENTS

| | | | |
|---|---|---|---|
| 2050154 | 1/1981 | United Kingdom | A61G 7/10 |
| WO91/06273 | 5/1991 | WIPO . | |

*Primary Examiner*—Michael F. Trettel

*Attorney, Agent, or Firm*—Cohen, Pontani, Lieberman, Pavane

[57] ABSTRACT

A lifting and transfer system for a patient includes a bed with a body portion, a patient-supporting portion and a raising device for raising, lowering and inclining the patient-supporting portion. A support frame includes an essentially vertically extending lifting pillar and an essentially horizontally extending lifting arm, wherein an end of the lifting arm is attached to the lifting pillar. A person lifter for lifting and lowering the patient is mounted on the free end of the lifting arm. The support frame is secured to the body portion of the bed at least during a patient transferring operation. The lifting pillar may be connected to the bed in such a way that is movable in a substantially horizontal direction along the end of the bed body. The lifting arm is attached to the lifting pillar such a way that it is pivotable in a substantially horizontal level about the vertical axis of the lifting pillar.

16 Claims, 11 Drawing Sheets

LIFTING AND TRANSFER SYSTEM FOR A PATIENT

BACKGROUND OF THE INVENTION

1. Field of the Invention

The present invention relates to a lifting and transfer system for a patient.

2. Description of the Related Art

Working conditions are often problematic when nursing mobility-impaired or paralyzed patients. Lifting the patient is ergonomically difficult for the nurses. Today, there are many kinds of auxiliary equipment available in hospitals for transferring and lifting the patients. Beds which are adjustable in height are generally considered to be the most important of these auxiliary equipment. Also, transfer chairs, different lifting devices, for example mobile lifting devices on legs, bathroom lifters, hoists in the ceiling, etc. are commonly used. Further, shower chairs, sliding platforms and bath platforms are used for transferring and bathing patients. However, these accessories are single devices designed for a specific use. It may be impractical to use such accessories as they require substantial space and they are not always available at the right time in the right place. Then, working in a hurry, the nurses tend to use their own physical strength rather than look for auxiliary equipment. Further, structurally light separate patient lifters are sometimes considered non-reliable for the safety of the patients, in particular if the nurses are inexperienced in using the accessories. U.S. Pat. Nos. 5,005,233 and 5,187,821 disclose hospital beds provided with a transfer couch and equipment for transferring a patient. An advantage provided by these systems is that they are integrated pans of the bed and am thus always available. Them is no need to bring many separate auxiliary devices to the bed when a patient is to be lifted and transferred. However, these devices can only be used for lifting and transferring a patient in a lying position.

SUMMARY OF THE INVENTION

The object of the present invention is to provide a simpler, safer and more versatile system than before for lifting, transferring and nursing a patient irrespective of the position of the patient.

A patient lifting and transferring system according to the invention includes a hospital bed or a corresponding nursing bed having a raisable, lowerable and inclinable patient-supporting portion, a raising device for the patient-supporting portion and a support frame for a person lifter which comprises a substantially elongate frame portion, a lifting pillar, and a second frame portion connected to the pillar. i.e. a lifting arm, wherein one end of the lifting arm is substantially horizontal and provided with the person lifter. A characteristic feature of the invention is that the support frame is stationarily secured to the bed body at least during a person lifting operation or a corresponding operation.

In an embodiment of the invention, the pillar of the support frame is secured to the bed body in such a way that it is movable in a substantially horizontal level in the direction of the end of the bed body; and that the lifting arm is disposed in the lifting pillar in such a manner that it is pivotable in a substantially horizontal level in relation to the vertical axis of the lifting pillar.

In another embodiment of the invention, the lifting pillar of the support frame is provided with a foot portion 4 detachably securing the support frame to the bed body. The lifting arm is mounted on the lifting pillar in such a way that it is pivotable in a substantially horizontal level in relation to the vertical axis of the lifting pillar. The foot portion can be secured to a side of the bed or to an end of the bed. The advantage provided this embodiment is the tact that the system of the present invention can be used in connection with suitable existing beds.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
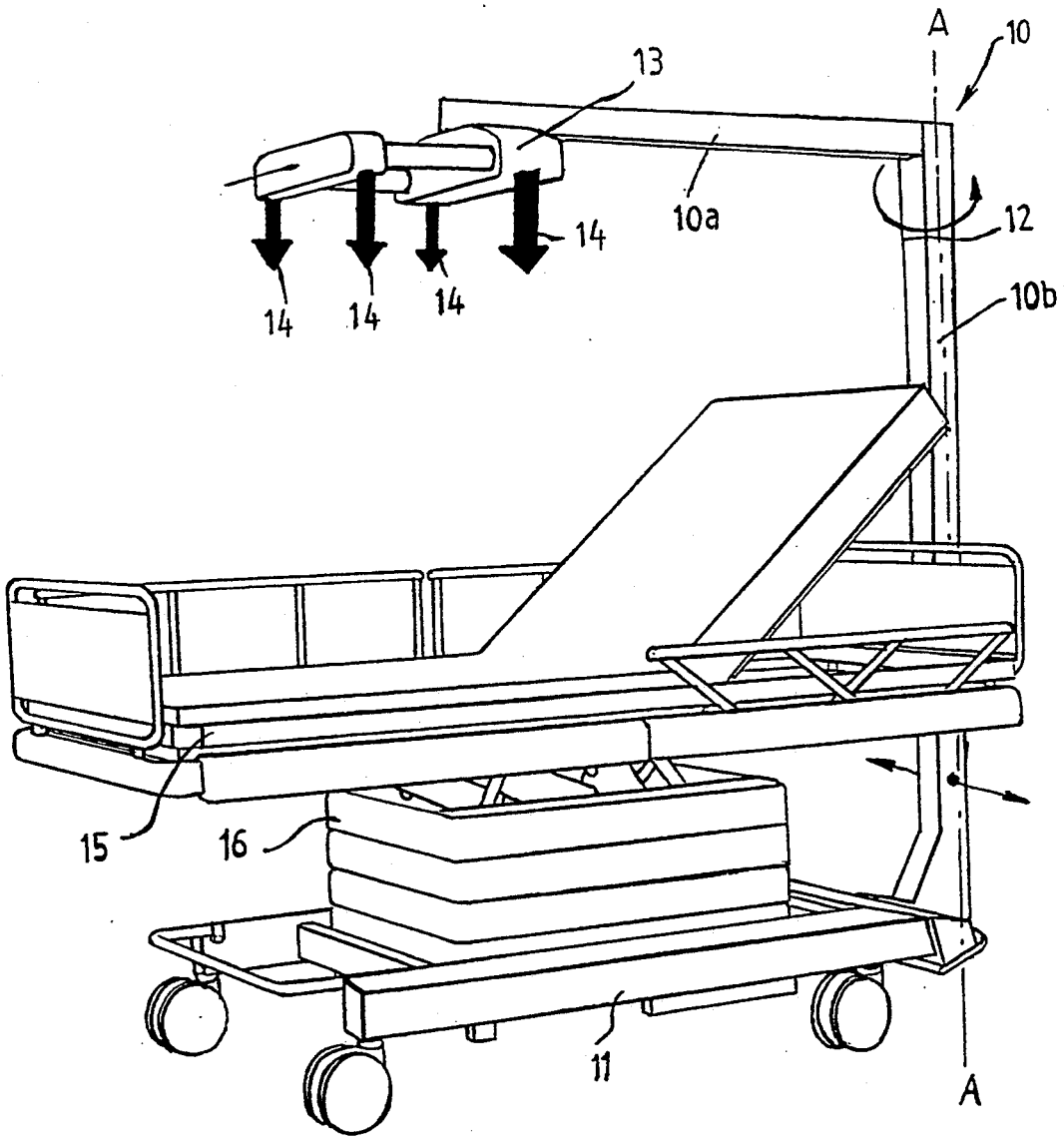
FIG. 1 is a perspective front view of the system according to the present invention.
Figure 2:
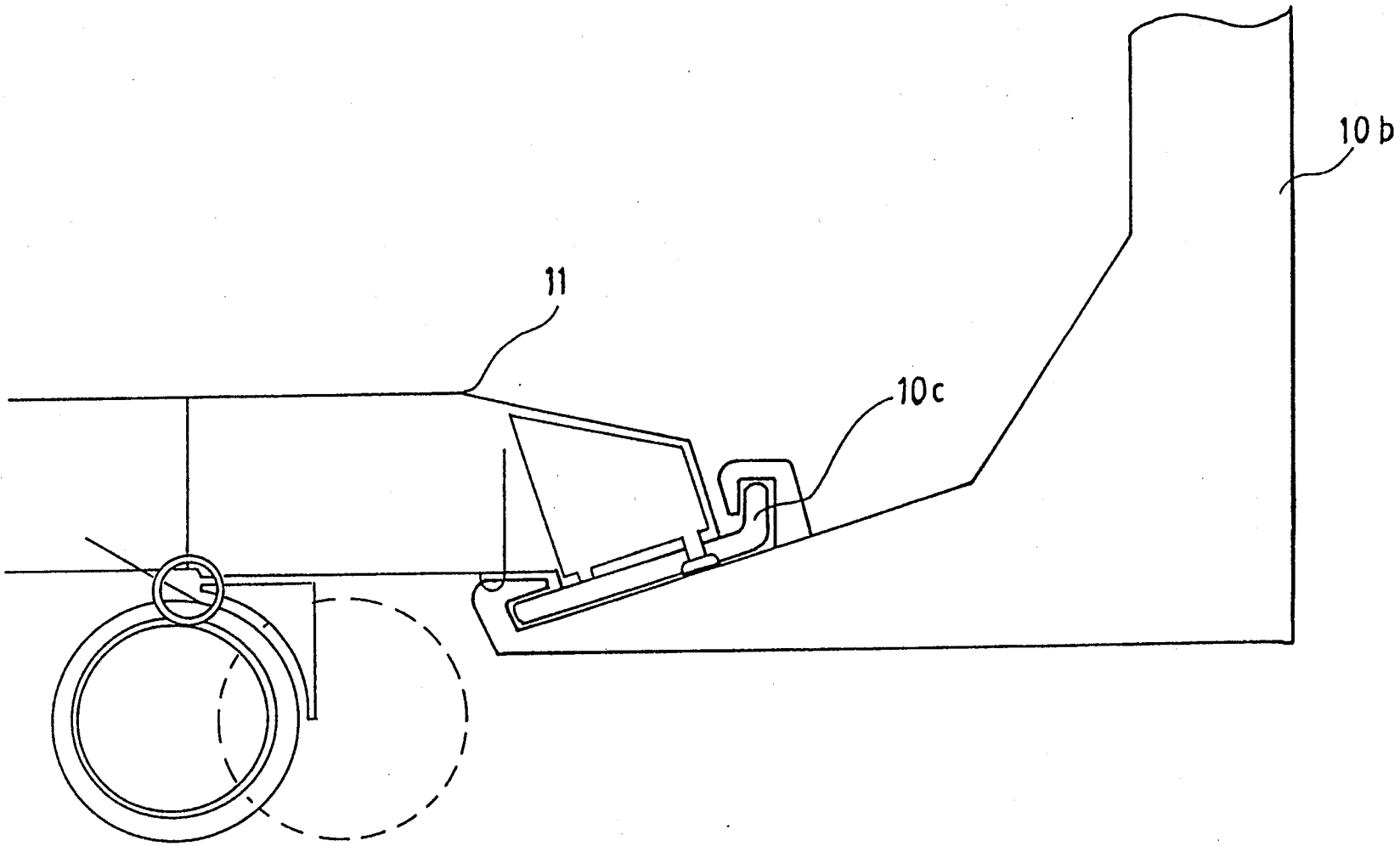
FIG. 2 is a schematic view, on a larger scale showing a detail of the support frame of the system of the present invention.
Figure 3A:
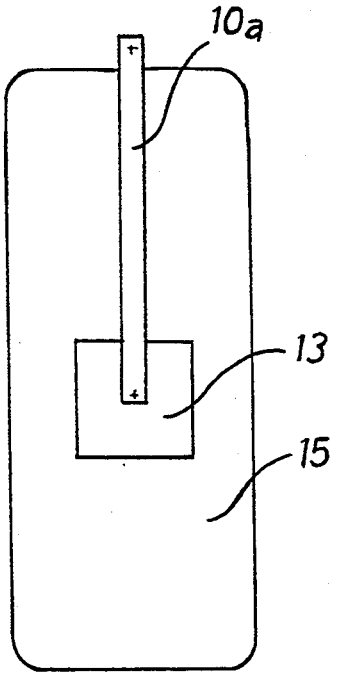
FIGS. 3*a* to 3*c* are schematic top views, on a smaller scale, showing different positions of operation of the support frame of FIG. 1.
Figure 3B:
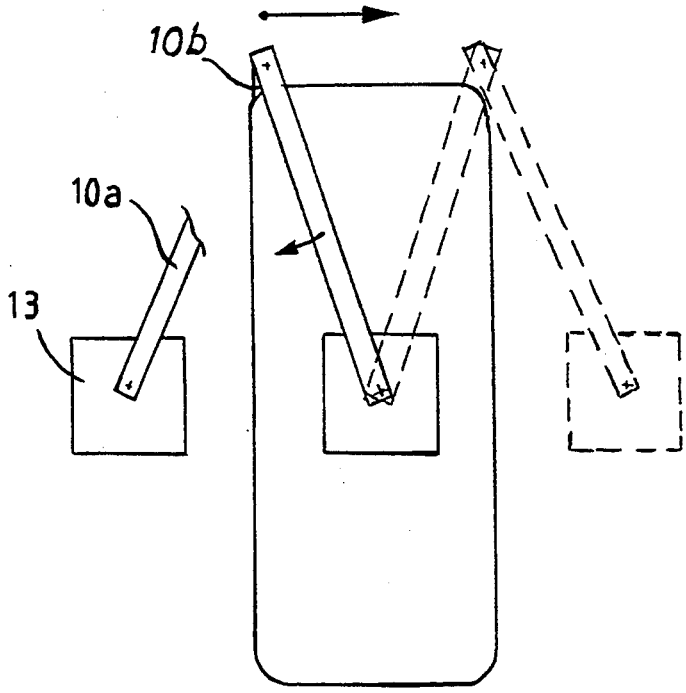
Figure 3C:
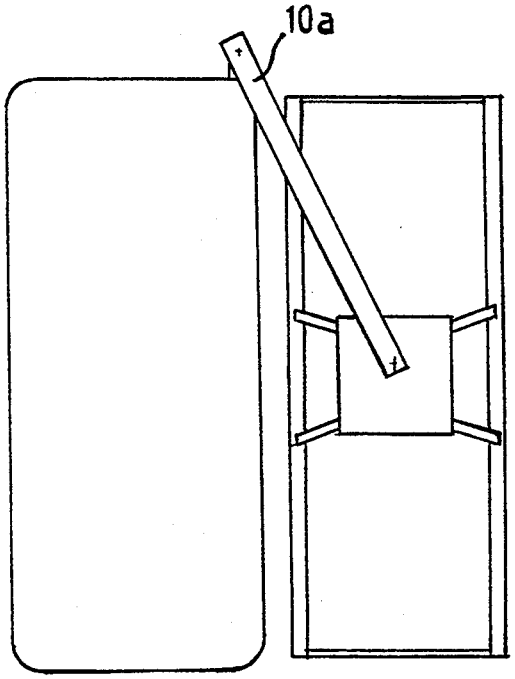
Figure 4B:
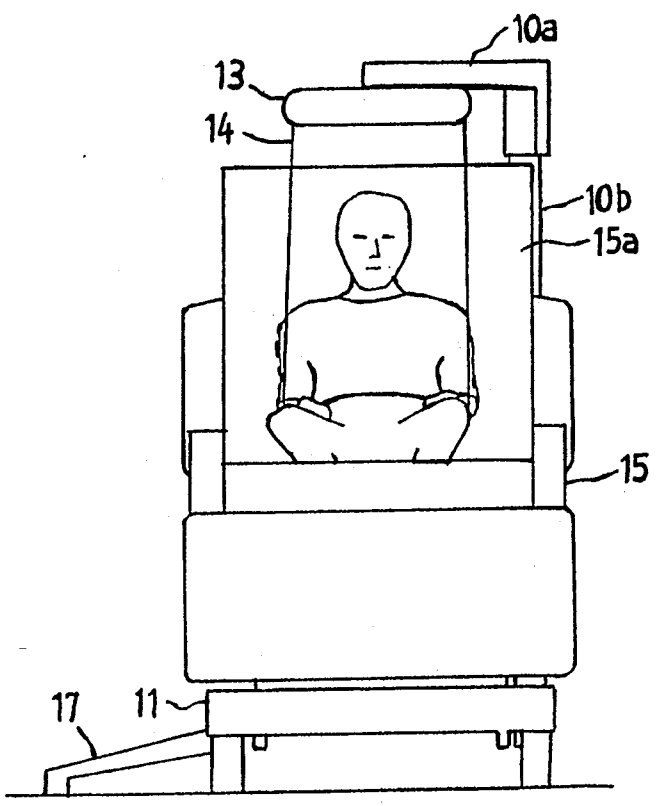
FIG. 4*b* is a front view of the system of FIG. 4*a;*
Figure 4A:
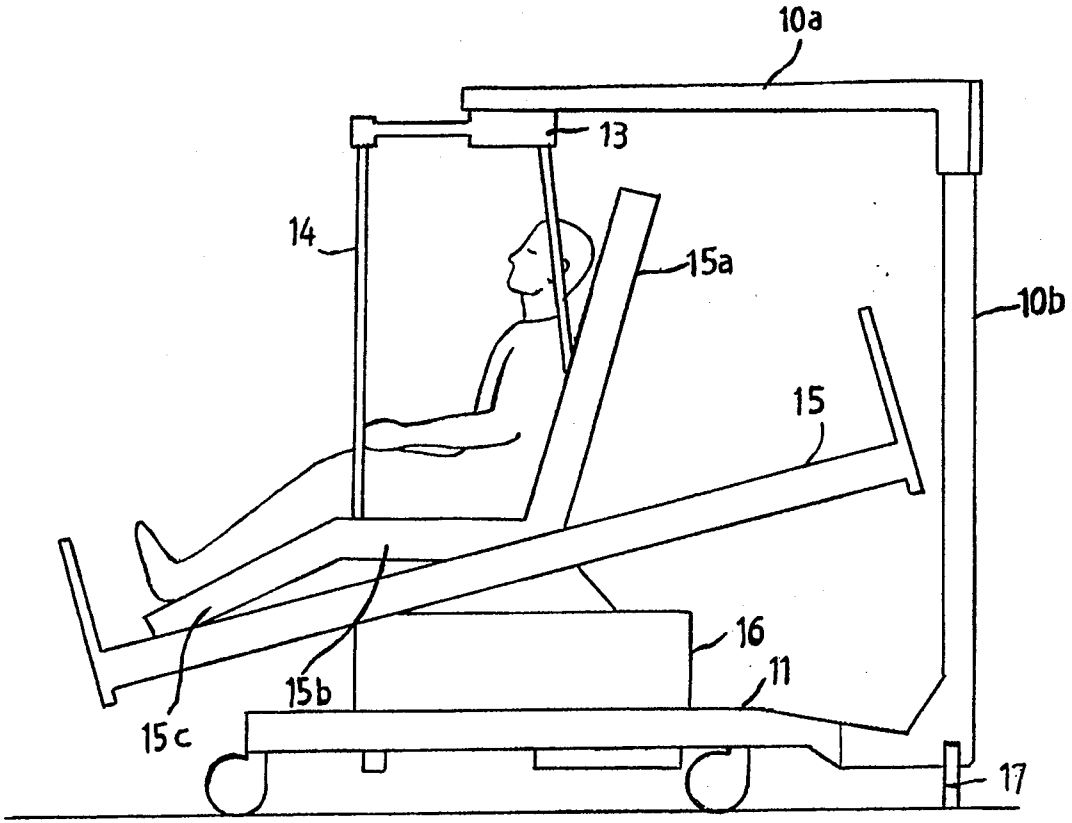
FIG. 4*a* is a schematic side view of the system illustrating the transfer of a patient in a sitting position.

FIG. 1 illustrates an embodiment of the invention. A hospital bed according to the invention comprises a support frame 10 formed by an elongated frame portion, i.e. a lifting pillar 10*b*, a second frame portion extending over the bed, i.e. a lifting arm 10*a*, and carrying means for transferring and lifting a patient supported by the support frame. According to this embodiment of the invention, one end of the lifting pillar 10*b* is connected to one of the ends of bed body 11 in such a way that the pillar can be moved in a horizontal level, i.e., in a direction transverse to the bed. The movement can be caused either manually or by means of power devices. A person lifter is mounted on the free end of the lifting arm 10*a*. The person lifter includes a four-point lifting mechanism 13 provided with four lifting belts 14 and a power means, preferably an electric motor, to move the rolled-up belts 14. The lifting pillar can be moved along the end of the bed body in a slide rail 10*c* illustrated in FIG. 2. The bed illustrated in FIG. 1 includes a patient-supporting portion 15, the height of which can be adjusted by a lifting device 16 illustrated encapsuled in FIG. 1, such as a scissors mechanism. The patient-supporting portion can also be inclined so as to have the head end of the bed up or down (the so-called Trendelenburg motion), and further the head end and the foot end can be separately set in different positions by known means with spindle motors. FIG. 3 illustrates schematically the location of the lifting pillar at the bed end during different operations. When the bed is transferred, or the patient is lifted but not transferred from the bed, for example, during nursing operations performed on the bed, the lifting pillar 10*b* is located somewhere in the middle of the bed end, as illustrated in FIG. 3*a*, and the lifting arm 10*a* is above the bed. When the patient, supported by the support frame, is lifted from the bed or lowered onto the bed, the lifting pillar 10*b* is transferred along the end of the bed body to either of the limit positions (FIG. 3*b*) at the corners of the bed end depending on the bed side which the patient is to be transferred to. When the lifting pillar 10*b* moves to this limit position a stabilizing leg 17 (FIGS. 5*a*, 5*b*) is extended automatically, i.e. by force, to ensure that the bed does not turn over while the patient is being transferred. The stabilizing leg can be also be stationary. When the patient on the patient supporting portion of the bed is to be transferred from the bed, the lifting arm 10*a* is pivoted to a position above the bed. The patient is suspended on the lifting belts and the lifting arm 10*a* is pivoted to a position beside the bed (FIGS. 3*b* and 3*c*). During the transfer the person lifter moves parallel with the bed so that less space is required beside the bed than in a situation where the lifter turns to the side. The four lifting belts 14 of the person lifter 13 work synchronously, i.e. they all lift at the same time. The patient can be lifted and transferred both in a sitting and in a lying position by means of this kind of support frame system which is stationarily connected to the bed at least during the lifting operation.

FIGS. 4*a*, 4*b*, 5*a* and 5*b* illustrate the transfer of a patient in a sitting position. It is advantageous for the transfer, if the inclination of the head end and the foot end of the patient-supporting portion of the bed can be adjusted separately. Further, the foot end preferably is composed of at least two portions movable in relation to each other, so that the adjustment of the inclination of the bed portion, for example, by the knees of the patient is also possible. Thus, the patient-supporting portion 15 of the bed has several portions (FIGS. 4*a* and 4*b*) movable in relation to each other, for example, a portion 15*a* supporting the back, a portion 15*b* supporting the thighs, and a portion 15*c* supporting the legs. The inclination of the portions can be adjusted by spindle motors.

Figure 5B:
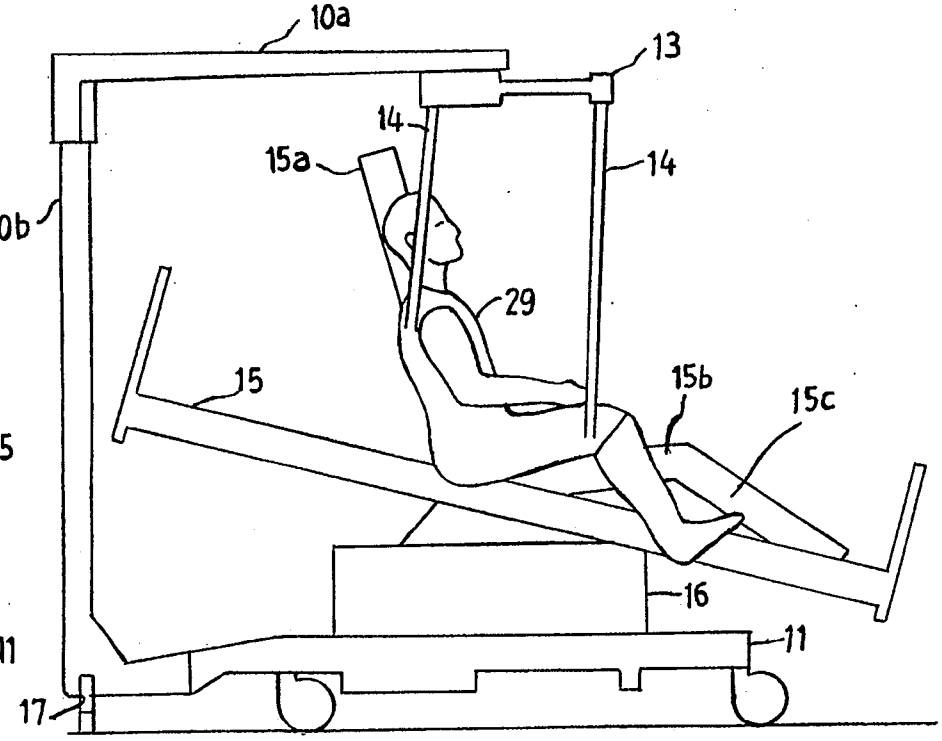
FIG. 5*b* is a side view of the system of FIG. 5*a* but modified to illustrate the system employed with a lifting vest.
Figure 5A:
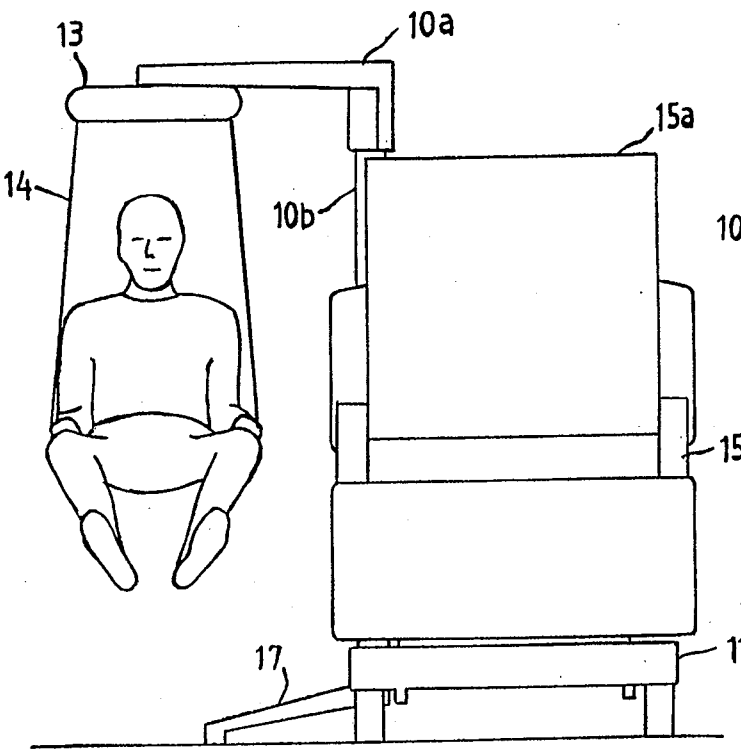
FIG. 5*a* is a schematic front view of the system showing a different position of operation.
Figure 9:
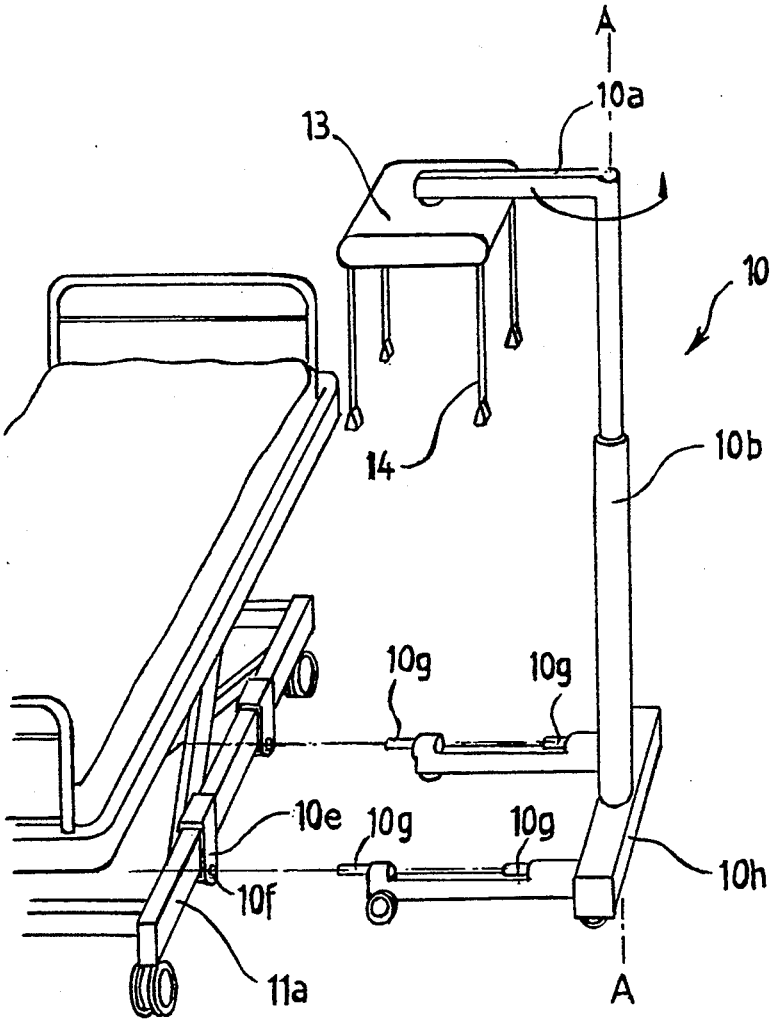
FIG. 9 is a perspective view of another embodiment of the system according to the present invention.
Figure 10A:
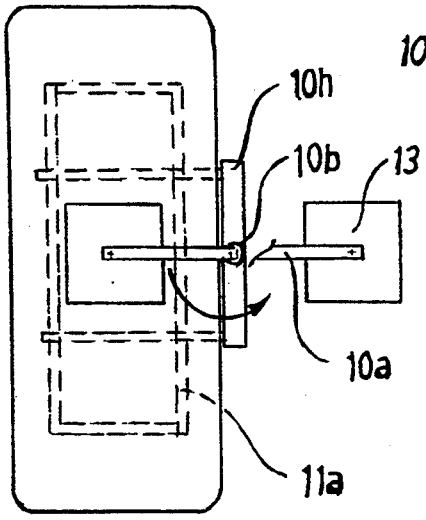
FIGS. 10*a* and 10*b* are schematic top views showing different positions of operation of the support frame of FIG. 9.
Figure 12:
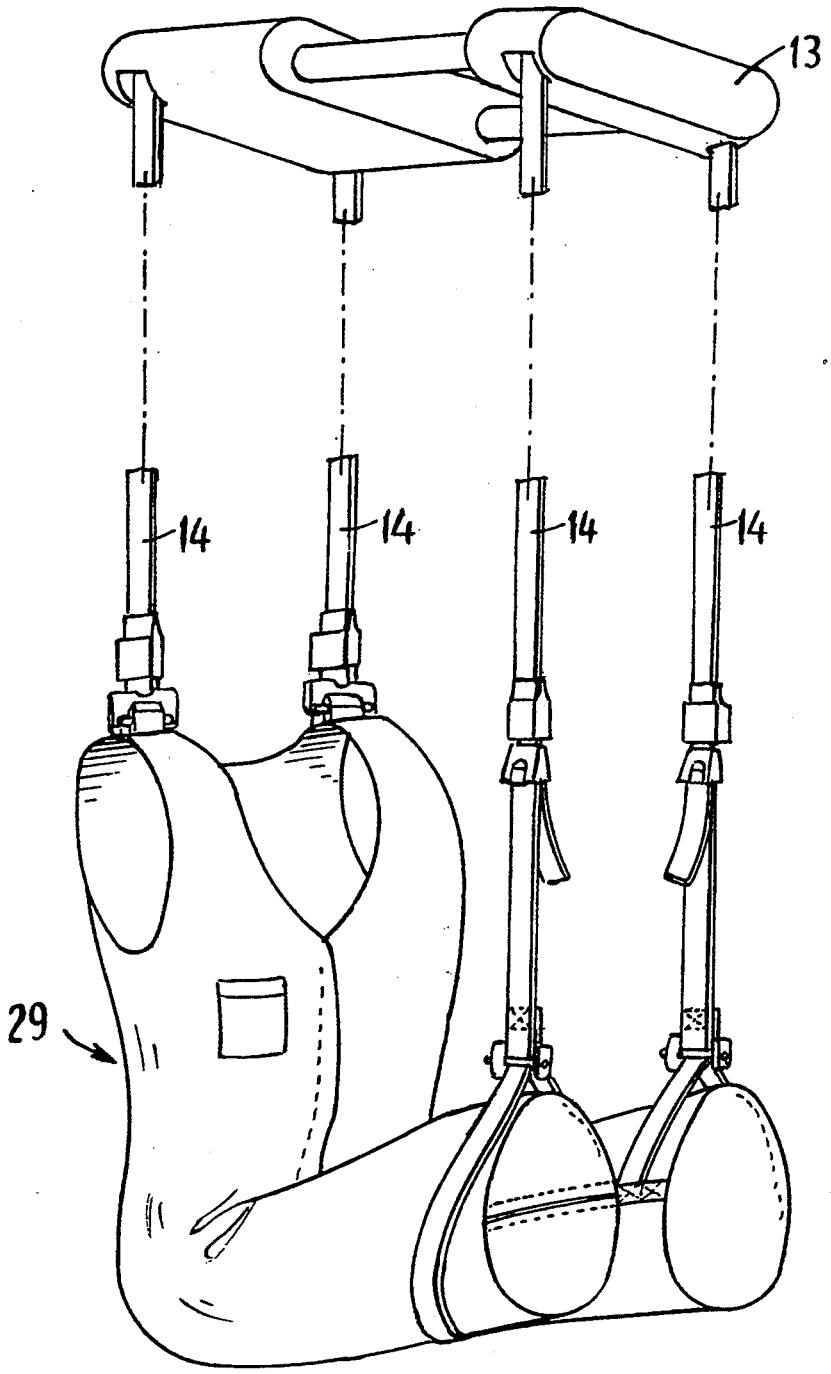
FIG. 12 illustrates an embodiment of the lifting vest of FIG. 5*b*.

The patient is lifted to a sitting position by inclining the head end and the foot end portions of the patient-supporting portion (FIGS. 5*a* and 5*b*). The lifting pillar 10*b* has been moved to one limit position of the bed end and the lifting arm 10*a* is pivoted above the bed. The height of the patient supporting portion 15 is adjusted appropriately and the patient-supporting portion is inclined to have the foot end downwards. By the adjustment of the patient-supporting portion of the bed and by the direct four-point lifting, the sitting position of the patient can be optimized so that it is not necessary to correct the position; rather, the position corresponds to the sitting position in a wheel chair. The patient is dressed in a lifting sheet or a lifting vest 29 which is secured, for example, by quick-locking means 29*a* (FIG. 12) to the lifting belts 14. The patient is lifted by the lifter 13 from the patient-supporting portion of the bed. The lifting arm 10*a* is pivoted to a position beside the bed (FIG. 5) such that the patient is beside the bed and ready to be lowered down by means of the lifter 13 to a wheel chair or a corresponding means. A lifting and transfer system integrated in the bed at least for the time of the lifting operation guarantees that it is always available. Due to the stationary structure, the lifting and transfer motions are always repeated in a similar manner whereas with separate auxiliary devices moved by the personnel they are not. Due to the repeated, robot-like movements, the operations of the lifter and the bed can be automated by known methods so that the patient can move himself or herself from the bed to a wheel chair or a corresponding means or back to the bed. This contributes to independent actions of the patient which is particularly important if the patient is nursed at home. The operation of the spindle motors inclining the patient-supporting portion of the bed and its portions can be controlled by logic control. Thus, it is possible to lift the patient to a predetermined appropriate sitting position by one push of a button. First the correct height of the patient-supporting portion is attained, then the appropriate knee angle, the inclination of the back portion, and then the inclination of the patient-supporting portion. The adjustment takes place one motion at a time. The patient-supporting portion can be restored to the basic horizontal position in the corresponding way. Also, the operations of the lifter and the support frame can be connected to the control mentioned above. Until now it has not been possible to combine the adjustment of the patient-supporting portion of the bed to support the lifting operation. Of course, it is not compulsory to automate the adjustment. Then the user of the bed must adjust the operations according to his judgment and experience. When the patient is totally confined to bed, he must be lifted and nursed in a lying position which can be carried out by means of a lifting frame 18 (FIGS. 6*a* and 6*b*) secured to the lifting belts 14. When the patient is on the lifting frame secured to the belts, the patient-supporting portion is lowered down and the lifting arm is pivoted to the side of the bed until the frame is moved in alignment with the bed to a position beside the bed (FIG. 3*c*) and can be lowered down to a transport platform. In this way, the patient can be transferred and the nursing personnel need not lift the patient. FIG. 9 illustrates another embodiment of the present invention by which the same advantages are achieved as with the embodiment of FIG. 1. According to this embodiment, the support frame is secured to the side of the bed. FIG. 9 illustrates one way of securing the support frame to the bed. Both side bars 11*a* of the bed body 11 are provided with securing members 10*e* having holes 10*f* into which pins 10*g* of the foot portion of the support frame are fitted. The securing point in the side bar of the bed may be adjusted as desired. The foot portion may be provided with an additional stabilizing leg for extra support points. The foot portion is preferably provided with wheels. The support frame can be secured to the side of the bed when the patient is transferred in a sitting position, for example from the bed to a wheel chair. FIG. 10*a* illustrates schematically the support frame of the person lifter by the side of the bed secured to the bed body 11. The person lifter 13 is at first above the bed such that the patient is suspended and supported by the lifting belts in a way corresponding to the one illustrated in FIGS. 4 and 5. The lifting arm 10*a* is turned, as the arrow indicates, to the side of the bed and the patient can be lowered down by means of the lifter 13 to a wheel chair or a corresponding device. Separate movable lifters, which stand on legs and can be brought beside the bed, are today generally used. However, it is not possible to achieve with these lifters the safe and fixed lifting path as with the system according to the present invention. With the prior art devices the transfer is performed by turning the whole lifter on wheels whereas according to the present invention the lifting arm pivots about one point which is possible because there are support points provided also in the range of the bed. In addition to the embodiment illustrated in FIG. 9, the detachable support frame can be attached to the bed body also by many other suitable known connecting means. For example, rails may be provided under the bed body into which the counter pieces of the lifter body are inserted and locked. A particularly formed plate may be provided under the bed body into which a corresponding plate or piece in a foot portion of the support frame is fitted and fixed.

Figure 6B:
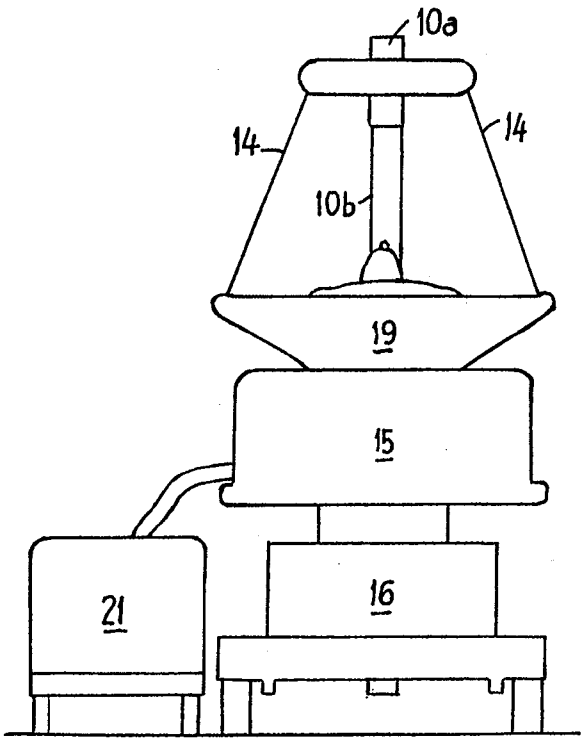
FIG. 6*b* is a front view of the system of FIG. 6*a;*
Figure 6A:
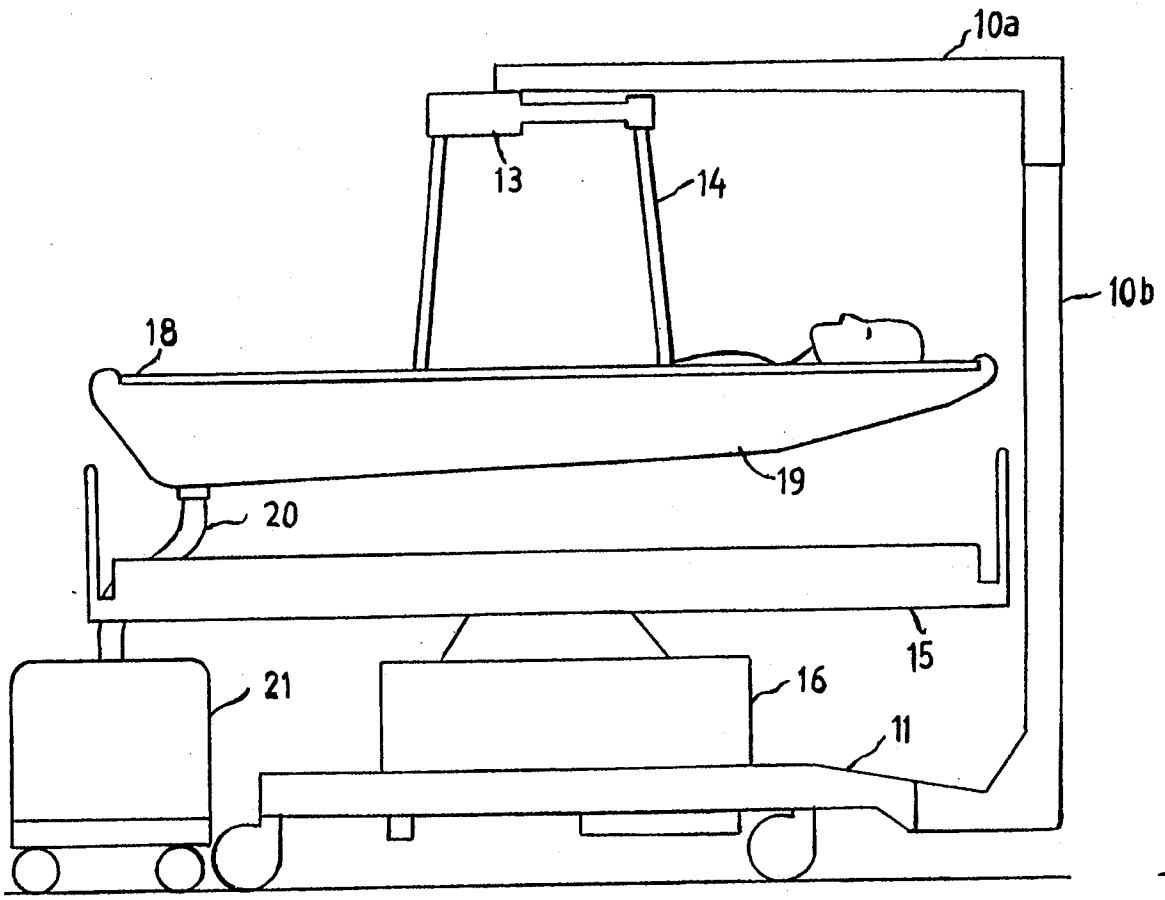
FIG. 6*a* is a schematic side view of the system showing the transfer of a patient in a lying position.
Figure 7:
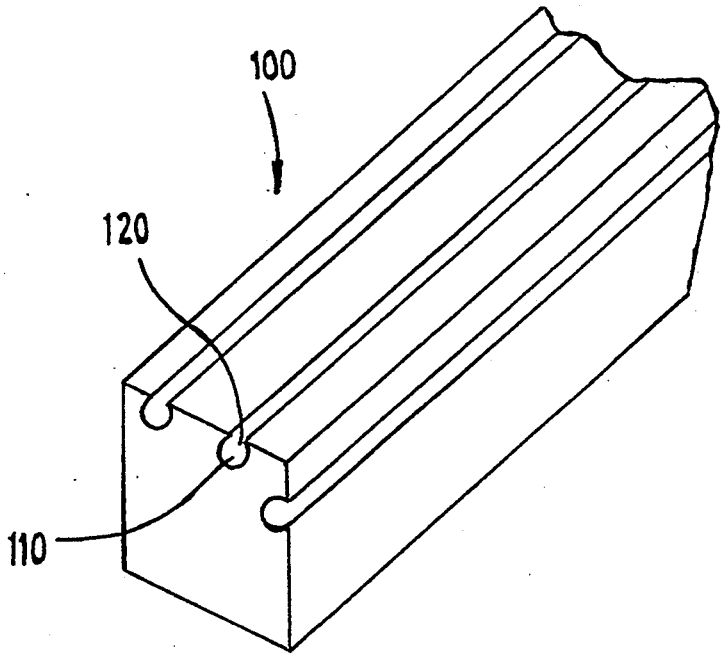
FIG. 7 is a partial perspective view of a profile bar serving as part of a lifting frame.
Figure 8A:
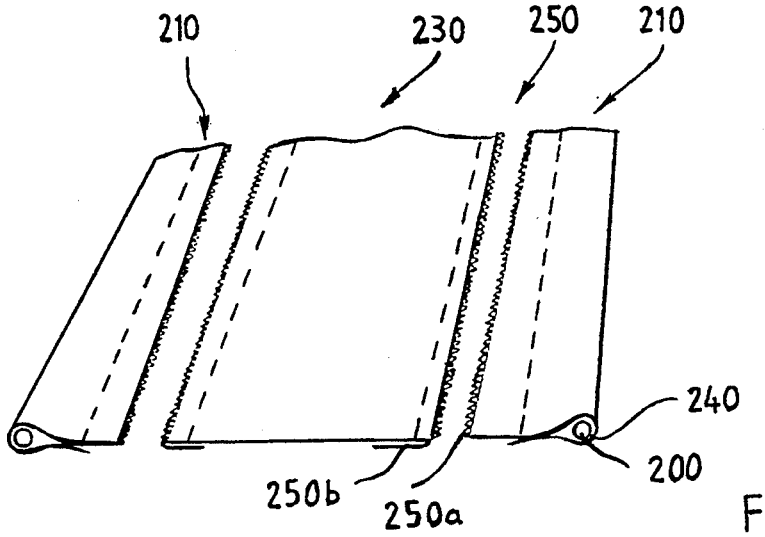
FIGS. 8*a* to 8*c* are perspective views showing means for securing a lifting sheet to the lifting frame.
Figure 8B:
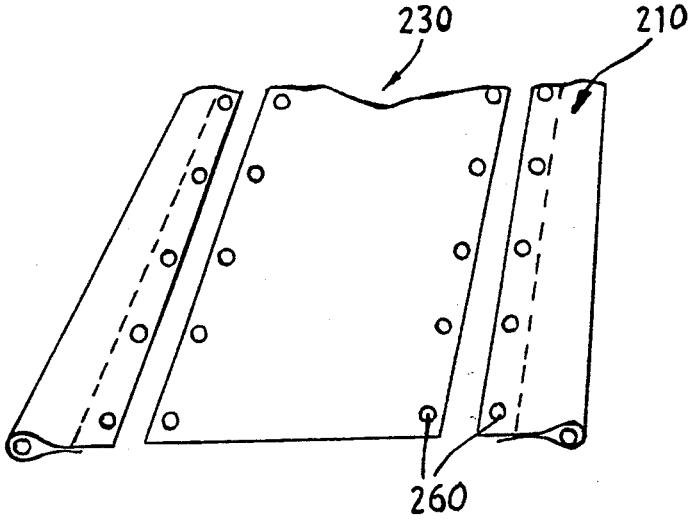
Figure 8C:
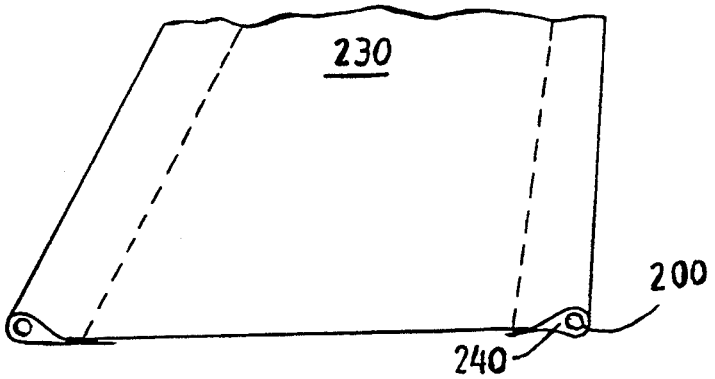
Figure 10B:
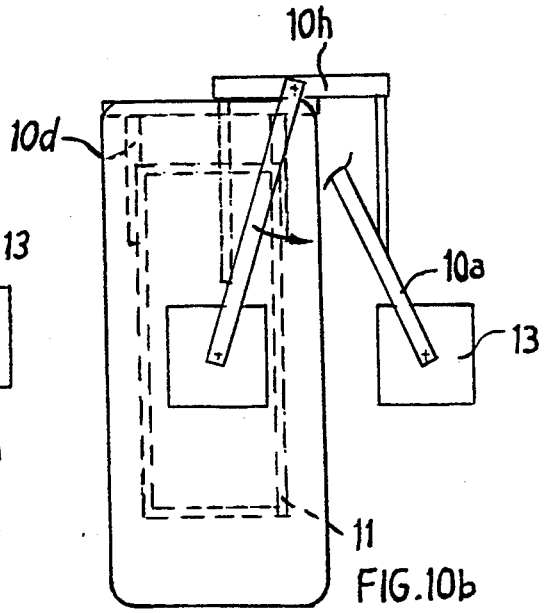
Figure 11A:
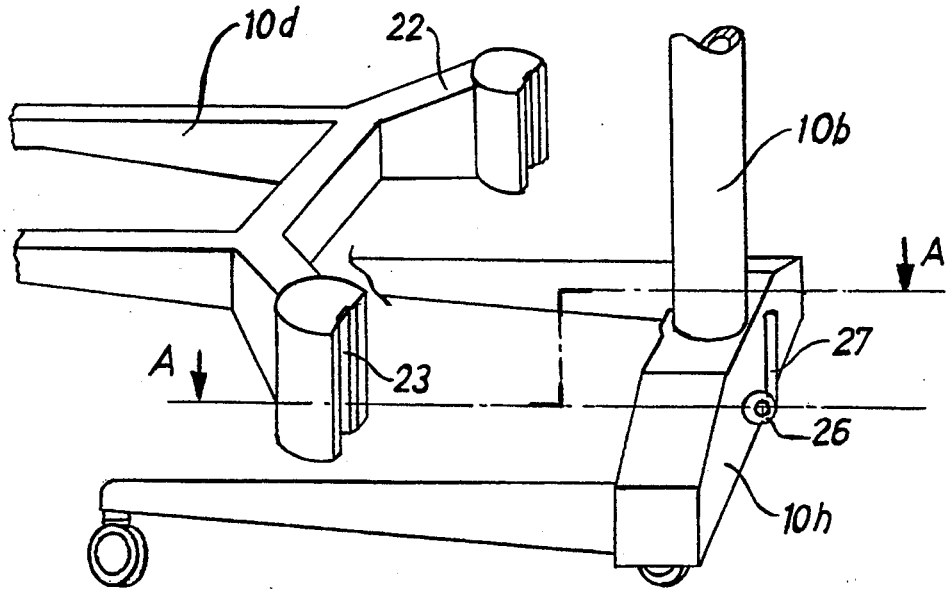
FIG. 11*a* is a perspective view showing a means for securing the support frame to the bed body.
Figure 11B:
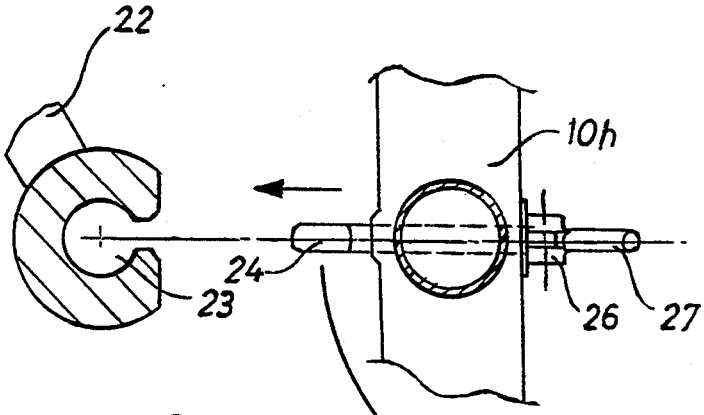
FIG. 11*b* is a sectional view taken along sectional line A—A of FIG. 11*a;*
Figure 11C:
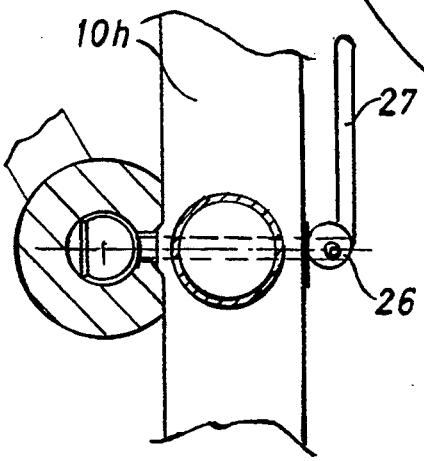
FIG. 11*c* is a sectional view, similar to FIG. 11*b*, showing the support frame and an auxiliary frame of the bed body being secured to each other.
Figure 11D:
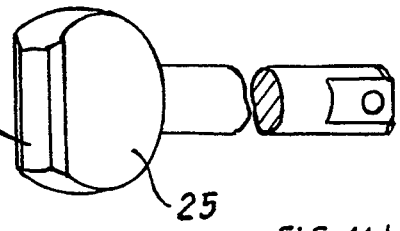
FIG. 11*d* illustrates a detail of the securing means of FIG. 11*b*.

In the embodiment illustrated in FIG. 10*b* the detachable support frame is connected at either end of the bed. If the existing bed body is not suitable, it is often necessary to connect the support frame 10 to the bed body 11 via an auxiliary frame 10*d* which has been previously connected to the bed body 11. The auxiliary frame is different for each type of bed body and receives the load caused by the lifting operation. The use of the auxiliary frame provides the advantage that one type of support frame of the person lifter can be connected to different types of bed bodies in order to provide a lifting and transfer system of the invention. When the patient is transferred according to FIG. 10*b* from or to the bed supported by the support frame, the support frame 10 is connected to the bed end so that the lifting pillar is situated in either limit position of the bed end. The support frame is secured to the auxiliary frame 10*d* which has essentially the shape of a U the bottom of which is parallel with the bed end and the sides are secured to the side bars 11*a* of the bed body. The foot portion 10*h* of the support frame may be provided with wheels and possibly also with a stabilizing leg. Also, the wheel can be lockable to serve as a stabilizer. The transfer of the patients is performed as described in connection with FIGS. 6*a* and 6*b*. FIGS. 11*a*–11*d* illustrate a way of securing the support frame 10 by securing means to the auxiliary frame 10*d*. The auxiliary frame 10*d* is provided with brackets 22 extending to the edge of the bed end. A groove 23 is provided in each bracket. A locking piece 24 in the surface of the foot portion 10*h* of the support frame is placed against the auxiliary frame, which locking piece can be fitted into the groove 23 in order to secure the support frame and the auxiliary frame to each other. FIG. 11*d* illustrates the locking piece in detail. The locking piece 24 is connected via a rod 25 to an eccentric 26 provided with a lever 27 and located on the opposite side of the foot portion. In FIG. 11*b*, the lever has been set free from the locking position and the locking piece 24 is inserted in the groove 23. When the lever is turned to the locking position, the piece 24 is locked in the groove 23. The support frame is now secured in its place according to FIG. 11*c* for the lifting and transfer operations. The support frame is locked in the groove in either of the brackets 22 depending on the side of the bed on which the lifting and corresponding operations are performed. The auxiliary frame 10*d* is secured to the bed body by ordinary known means, such as screws or mechanical U-joints. The lifting frame 18 to be fastened to the belts 14 is preferably made of profile bars 100 (FIG. 7) into the grooves 110 of which the sheet under the patient can be secured, the sheet thus serving both as a bedding sheet and a lifting sheet. Also a washing underlay element, for example a PVC-coated polyester mesh, can be secured to the frame under the patient which makes possible bathing the patient conveniently in his own bed in his own room both in institutions and at home, as illustrated in FIGS. 6*a* and 6*b*. A water impervious element 19 is secured in the groove of the frame 18 under the washing mesh. The element 19 collects the washing water and is provided with an orifice connected to a hose 20 for discharging the water, for example, to a floor drain for a water collecting basin 21. The lifting sheet or a corresponding means can be connected to the profile bar by many different means. An advantageous application of securing the lifting sheet to the groove in the profile bar is illustrated in FIG. 8*a*. The means is an elongate thin piece 200, such as a string, a band, a solid plastic bar or a corresponding means, and a strip 210 made of a bendable material the length of which preferably corresponds to the length of the long side of the lifting sheet 230. One long side of the strip 210 is formed so as to provide a tubular passage 240 into which the piece 200 is pushed, and the other long side of the strip is provided with a counter edge 250*a* of a connecting means 250 used for connecting the strip to the lifting sheet. The other counter edge 250*b* is provided in the long side of the lifting sheet. The interconnecting means is preferably a zipper. The edge of the strip 210 including the elongate piece 200 is pushed inside a groove 110 from the end of the profile bar 100 (FIG. 7) and the edge with the counter edge of the interconnecting means, i.e. the half 250*a* of the zipper, remains outside the groove via a longitudinal slot 120 in the groove and is detachably securable to the zipper half 250*b* in the lifting sheet. This securing method allows fast and simple changes of the lifting sheet or the like underlay element. Instead of a zipper, holes 260 can be provided in the lifting sheet 230 and the strip 210, through which the securing is performed by clips, hooks, or other locking means (FIG. 8*b*). Alternatively, hooks disposed in the groove of the profile bar and connected to holes in the lifting sheet may be used. The elongate piece 200 may also be disposed in a tubular passage 240 provided directly in the sides of a simple, one-piece lifting sheet 230 (FIG. 8*c*). The sides of the lifting sheet containing the elongate pieces must be fitted into the grooves of the profile bar. The slot in the groove must be substantially narrower than the diameter of the groove so as to prevent the elongate piece, the hook or the like member disposed in the groove, from slipping out from the groove. The elongate piece or the corresponding member must be dimensioned such that the piece or the member can be inserted easily into the groove but cannot slip out through the slot. The cross section of the grooves in the bar may be of circular form or, alternatively, of triangular, square or rectangular configuration the profile bar may be made of, for example, aluminum, steel or a composite material.

The lifting frame preferably has long sides which are profile bars, and shorter sides which connect the long sides and are supporting bars. Further, the system of the invention allows securing various auxiliary devices in the grooves of the lifting frame such as skull or limb tension arrangements and infusion equipment. These devices, which are known as such, are secured for example via an adapter in the groove of the profile bar. For example, a limb tension patient has previously been confined to bed in such a way that it has been very difficult to nurse him or her. Due to the system of the present invention, the patient is no longer confined to bed but only to the lifting frame which can be lifted and moved and the patient thus nursed in the way described above. The invention provides many advantages compared to prior art beds. The stationary lifting and transfer system is applicable both in institutions and at home in the treatment and lifting of both patients who can sit and patients who are totally unable to move. The work of the nursing personnel is minimized in the transfer which saves time and strength. The movements required are ergonomically correct. The system is safe for the patient because the lifting apparatus is integrated in the bed and thus the lifting path is always the same and predetermined. The patient is not dependent on the experience of the nursing personnel which he is when separate patient lifting and transfer devices are used.

The invention is not limited by the embodiments described above which are presented as examples only but can be modified in various ways within the scope of protection defined by the appended patent claims.

We claim:

1. A lifting and transfer system for a patient, the system comprising a bed with a body portion, a patient-supporting portion and a raising device for raising, lowering, and inclining the patient-supporting portion, a support frame comprising an essentially vertically extending lifting pillar portion and an essentially horizontally extending lifting arm portion having first and second ends, the first end being attached to the lifting pillar portion, and a person lifting means for lifting and lowering the patient, the person lifting means being mounted on the second end of the lifting arm portion, wherein the person lifting means comprises a four-point lifting means comprising four belts and a power transmission means for lifting and lowering the patient, the support frame being secured to the body portion of the bed at least during a patient transferring operation.

2. The system according to claim 1, wherein the body portion of the bed has two ends and two sides, the lifting pillar portion of the support frame being secured to one of the ends of the body portion so as to be slidable horizontally along the end of the body portion between limit positions, the vertically extending lifting pillar portion having an axis, the lifting arm portion being attached to the lifting pillar portion so as to be pivotable in a substantially horizontal plane about the axis of the lifting pillar portion.

3. The system according to claim 2, further comprising at least one stabilizing means extendable from the body portion of the bed for stabilizing the support frame when the lifting pillar portion of the support frame is in one of the limit positions.

4. The system according to claim 3, further comprising means for automatically extending the stabilizing means.

5. The system according to claim 3, wherein the stabilizing means is stationary.

6. The system according to claim 1, wherein the lifting pillar portion of the support frame comprises a foot portion, means for securing the foot portion to the body portion of the bed, the vertically extending lifting pillar portion having an axis, the lifting arm portion being attached to the lifting pillar portion so as to be pivotable in a substantially horizontal plane about the axis of the lifting pillar portion.

7. The system according to claim 6, wherein the body portion of the bed has two ends and two sides, and wherein the foot portion is secured to one of the ends of the body portion.

8. The system according to claim 6, wherein the body portion of the bed has two ends and two sides, and wherein the foot portion is secured to one of the sides of the body portion.

9. The system according to claim 6, further comprising an auxiliary frame for securing the foot portion of the lifting pillar portion to the body portion.

10. The system according to claim 9, wherein the body portion has two ends, and wherein the auxiliary frame is secured to one of the ends of the body portion.

11. The system according to claim 1, comprising a lifting vest secured to the four-point lifting means for lifting and lowering the patient.

12. The system according to claim 1, comprising a lifting frame secured to the four-point lifting means for lifting and lowering the patient.

13. The system according to claim 1, wherein the patient-supporting portion comprises a plurality of portions movable and inclinable relative to each other.

14. The system according to claim 13, wherein the portions of the patient-supporting portion comprise portions for supporting the back of a patient, for supporting the thighs of a patient, and for supporting the legs of a patient.

15. The system according to claim 13, comprising means for automatically moving and inclining the portions of the patient-supporting portion.

16. The system according to claim 15, further comprising means for automatically operating the person lifting means and the support frame.

* * * * *